US010779625B2

(12) United States Patent
Thein

(10) Patent No.: US 10,779,625 B2
(45) Date of Patent: Sep. 22, 2020

(54) BATTERY POWERED COLLAPSIBLE BLOW-DRYER

(71) Applicant: Christine Thein, Oakdale, PA (US)

(72) Inventor: Christine Thein, Oakdale, PA (US)

( * ) Notice: Subject to any disclaimer, the term of this patent is extended or adjusted under 35 U.S.C. 154(b) by 165 days.

(21) Appl. No.: 16/030,418

(22) Filed: Jul. 9, 2018

(65) Prior Publication Data

US 2020/0008552 A1 Jan. 9, 2020

(51) Int. Cl.
*A45D 20/10* (2006.01)

(52) U.S. Cl.
CPC ..... *A45D 20/10* (2013.01)

(58) Field of Classification Search
CPC ..... D06F 58/24; A45D 20/12
USPC ..... 34/97
See application file for complete search history.

(56) References Cited

U.S. PATENT DOCUMENTS 4,198,558 A * 4/1980 Benty ..... A45D 20/12 132/212
4,309,595 A * 1/1982 Long ..... A45D 20/10 338/305
4,683,369 A * 7/1987 Rieckman ..... A45D 20/12 200/302.1
4,757,183 A * 7/1988 Karey ..... A45D 20/10 392/341
4,904,847 A * 2/1990 Kosaka ..... A45D 20/12 392/384
5,195,253 A 3/1993 Poumey et al.
5,608,975 A * 3/1997 Hsu ..... A45D 20/06 34/96
5,884,008 A * 3/1999 Goldberg ..... A45D 20/12 206/320
6,216,363 B1 * 4/2001 Swansen ..... A47K 10/48 34/415
7,380,347 B2 6/2008 Coats
9,756,922 B1 * 9/2017 Duthe ..... A45D 20/12
2002/0157276 A1 10/2002 Mujica
2007/0126290 A1 * 6/2007 Jaynes ..... H02J 2207/40 307/150
2011/0197466 A1 * 8/2011 Shami ..... A45D 20/12 34/283
2016/0324292 A1 * 11/2016 Depoyian ..... A45D 20/50
2017/0000234 A1 * 1/2017 Annunziata ..... A45D 20/12
2018/0295964 A1 * 10/2018 Otero ..... A45D 20/10

* cited by examiner

*Primary Examiner* — Edelmira Bosques
*Assistant Examiner* — Bao D Nguyen

(57) ABSTRACT

A battery powered collapsible blow-dryer for portable hair drying and styling includes a blow-dryer housing. A pivot hinge is coupled to a ventral side of the blow-dryer housing adjacent an intake end. A handle has a handle cavity disposed between an anterior side, a posterior side, an upper end, and a bottom end. The upper end has a pivot receptacle pivotably coupled to the pivot hinge. The pivot receptacle comprises a locking mechanism to maintain the handle in a folded position and an alternate extended position, and a button to release the handle. A blow-dryer assembly comprises a heating element and a fan coupled within the blow-dryer housing, and a plurality of controls coupled to the handle. A power assembly comprises a solar panel coupled to the blow-dryer housing, a rechargeable battery coupled within the handle cavity, and a charging port coupled within the bottom end of the handle.

1 Claim, 4 Drawing Sheets

BATTERY POWERED COLLAPSIBLE BLOW-DRYER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to blow-dryers and more particularly pertains to a new blow-dryer for portable hair drying and styling.

BRIEF SUMMARY OF THE INVENTION

An embodiment of the disclosure meets the needs presented above by generally comprising a blow-dryer housing having an outer wall, an inner wall, an exhaust end, an intake end, a dorsal side, and a ventral side. A grill is coupled within the exhaust end of the blow-dryer housing. A pivot hinge is coupled to the ventral side of the blow-dryer housing adjacent the intake end. A handle has a handle cavity disposed between an anterior side, a posterior side, an upper end, and a bottom end. The upper end has a pivot receptacle pivotably coupled to the pivot hinge. The pivot receptacle comprises a locking mechanism to maintain the handle in a folded position and an alternate extended position, and a button to release the handle from the folded position and the extended position. A blow-dryer assembly comprises a heating element, a fan, and a plurality of controls. The heating element and the fan are coupled within the blow-dryer housing and the plurality of controls is coupled to the handle. The blow-dryer assembly takes air through the intake end, heats the air, and forces it through the exhaust end of the blow-dryer housing. The plurality of controls operates the heating element and the fan. A power assembly comprises a solar panel coupled to the blow-dryer housing, a rechargeable battery coupled within the handle cavity, and a charging port coupled within the bottom end of the handle through to the handle cavity. The solar panel and the charging port provide power to the rechargeable battery, and the rechargeable battery provides power to the blow-dryer assembly.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
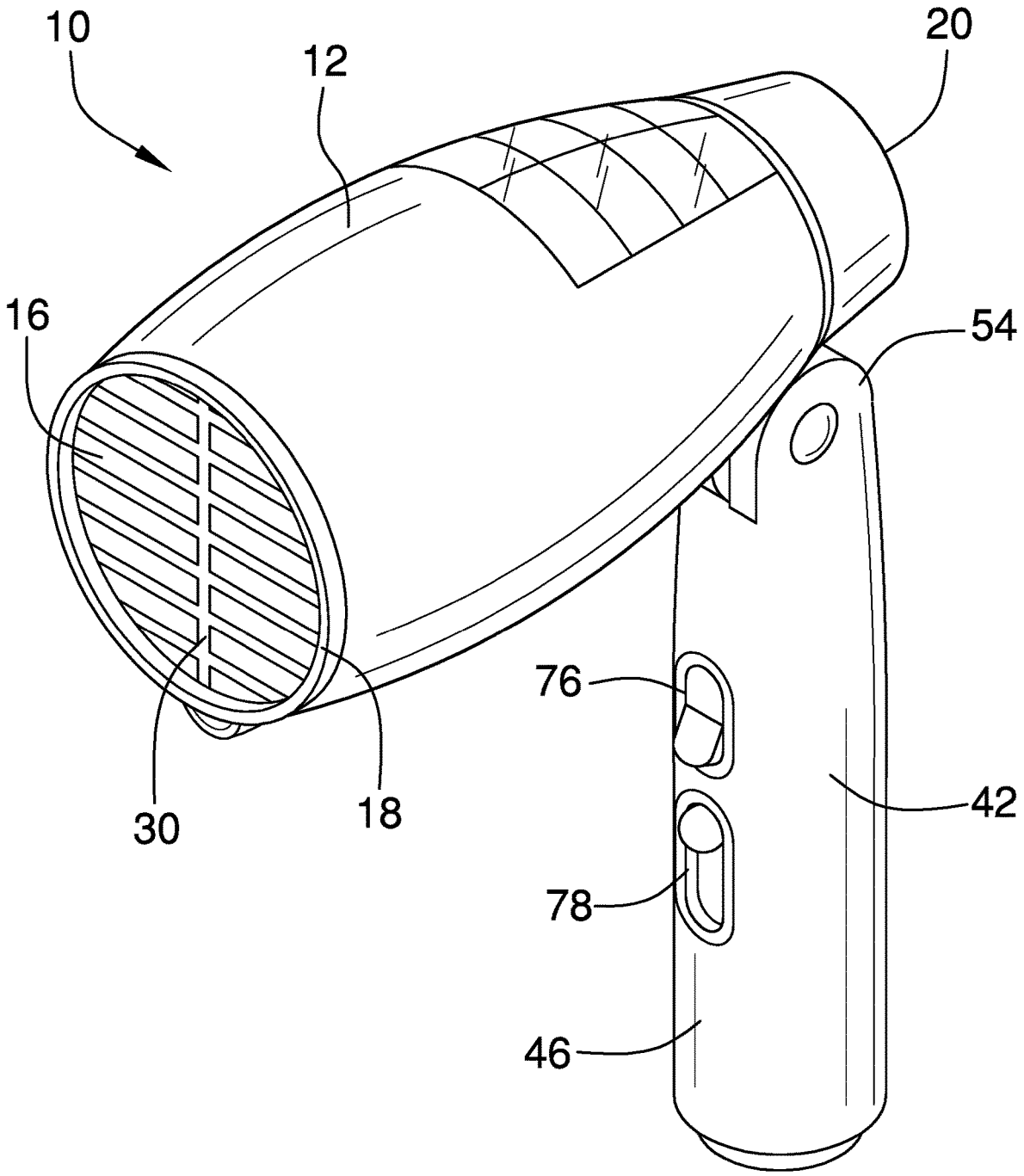
FIG. 1 is an isometric view of a battery powered collapsible blow-dryer according to an embodiment of the disclosure.
Figure 2:
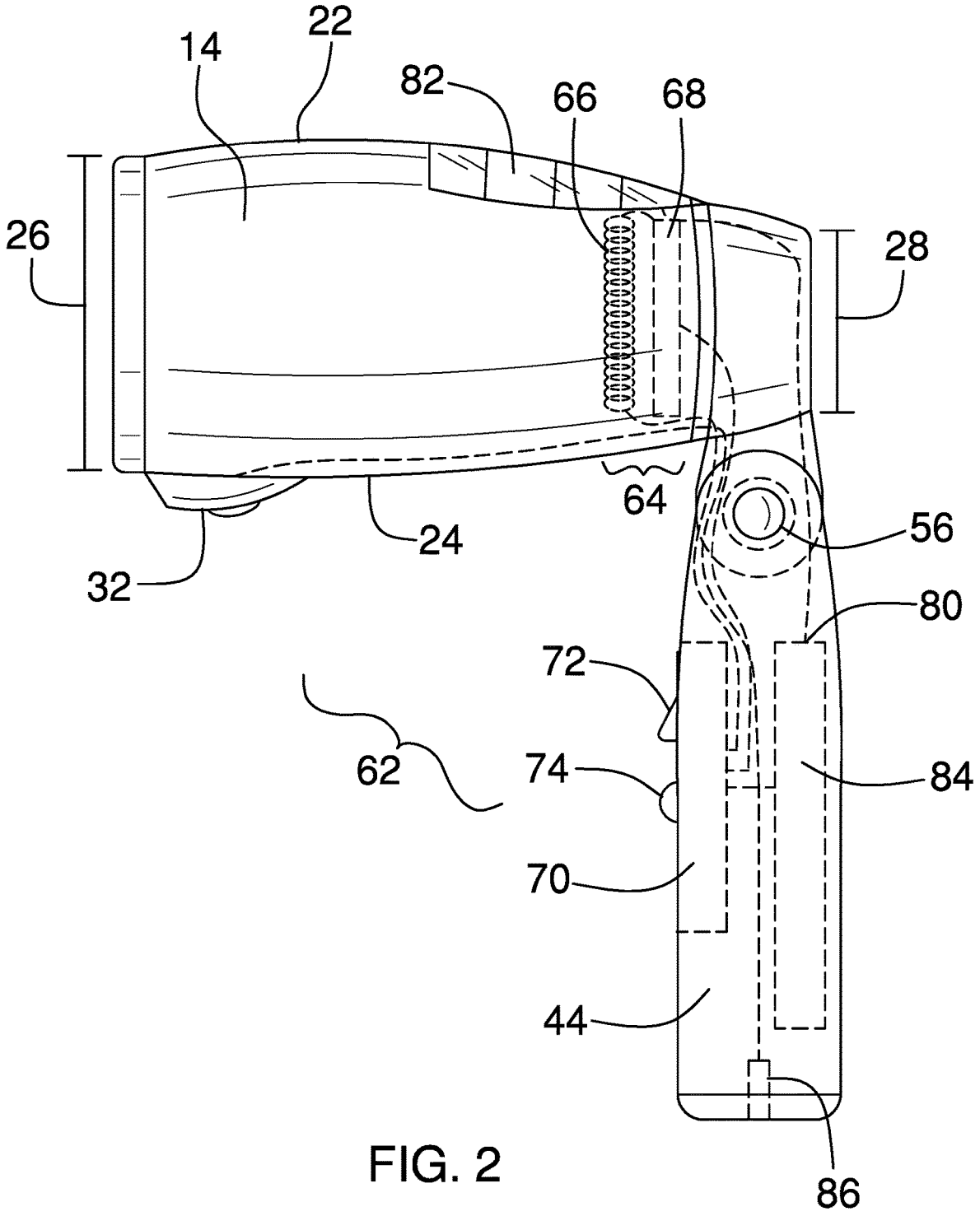
FIG. 2 is a side elevation view of an embodiment of the disclosure.
Figure 3:
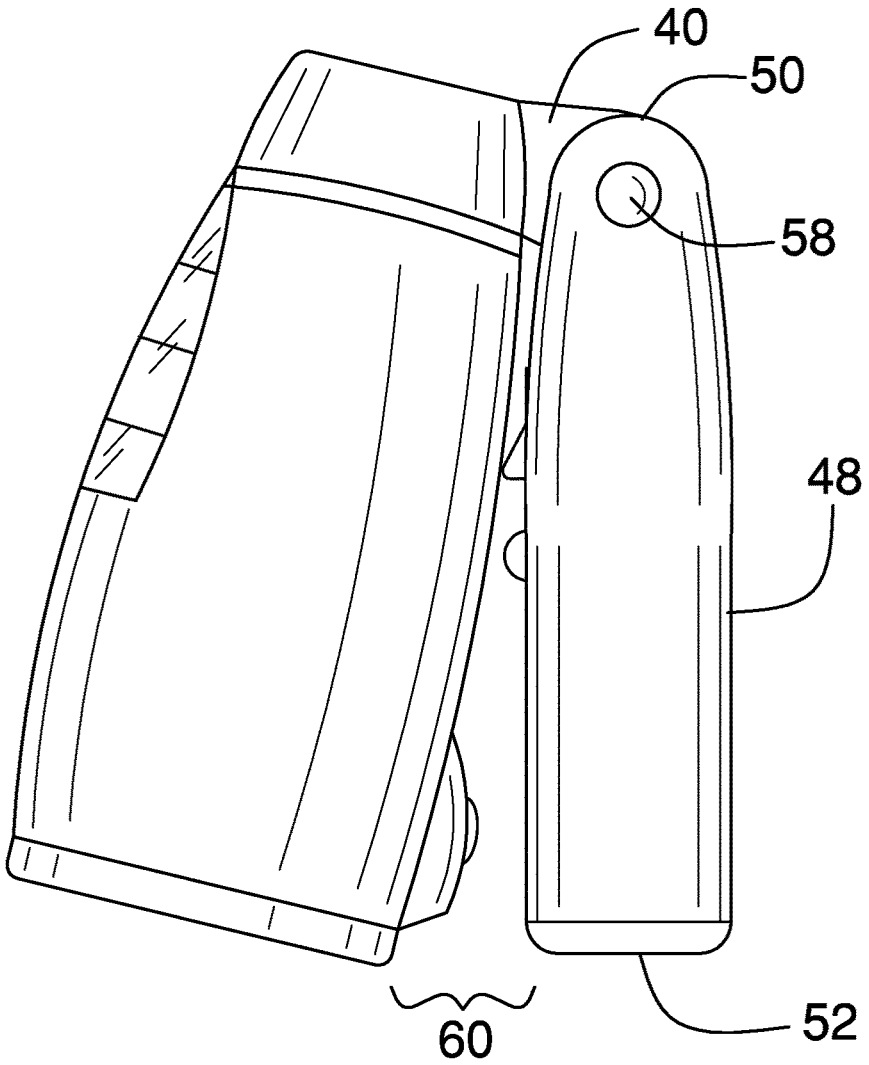
FIG. 3 is a side elevation view of an embodiment of the disclosure in a folded position.
Figure 4:
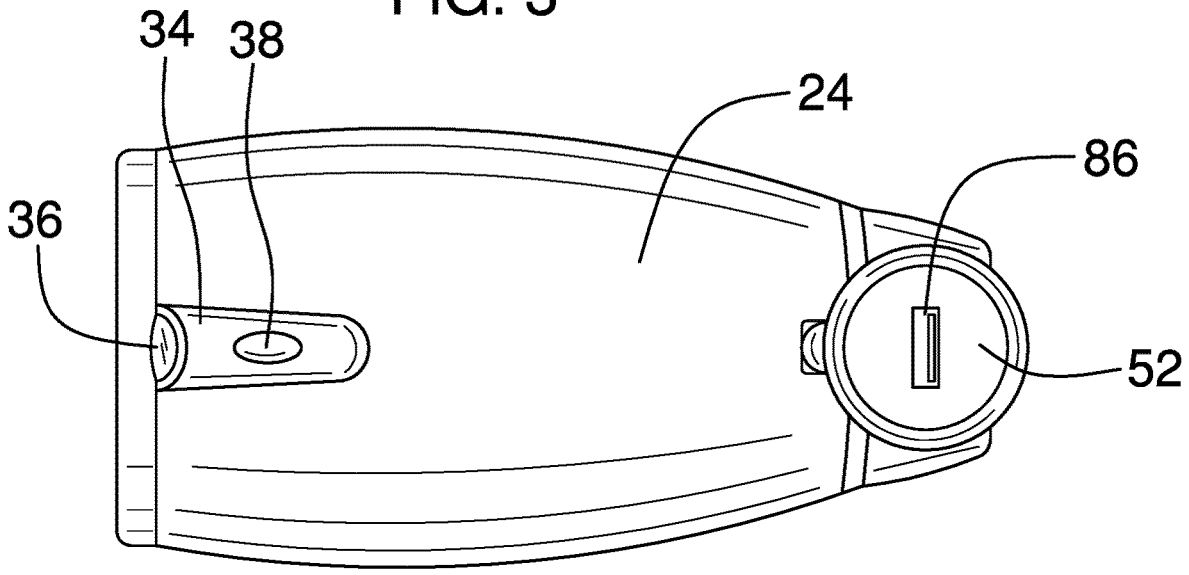
FIG. 4 is a bottom plan view of an embodiment of the disclosure.
Figure 5:
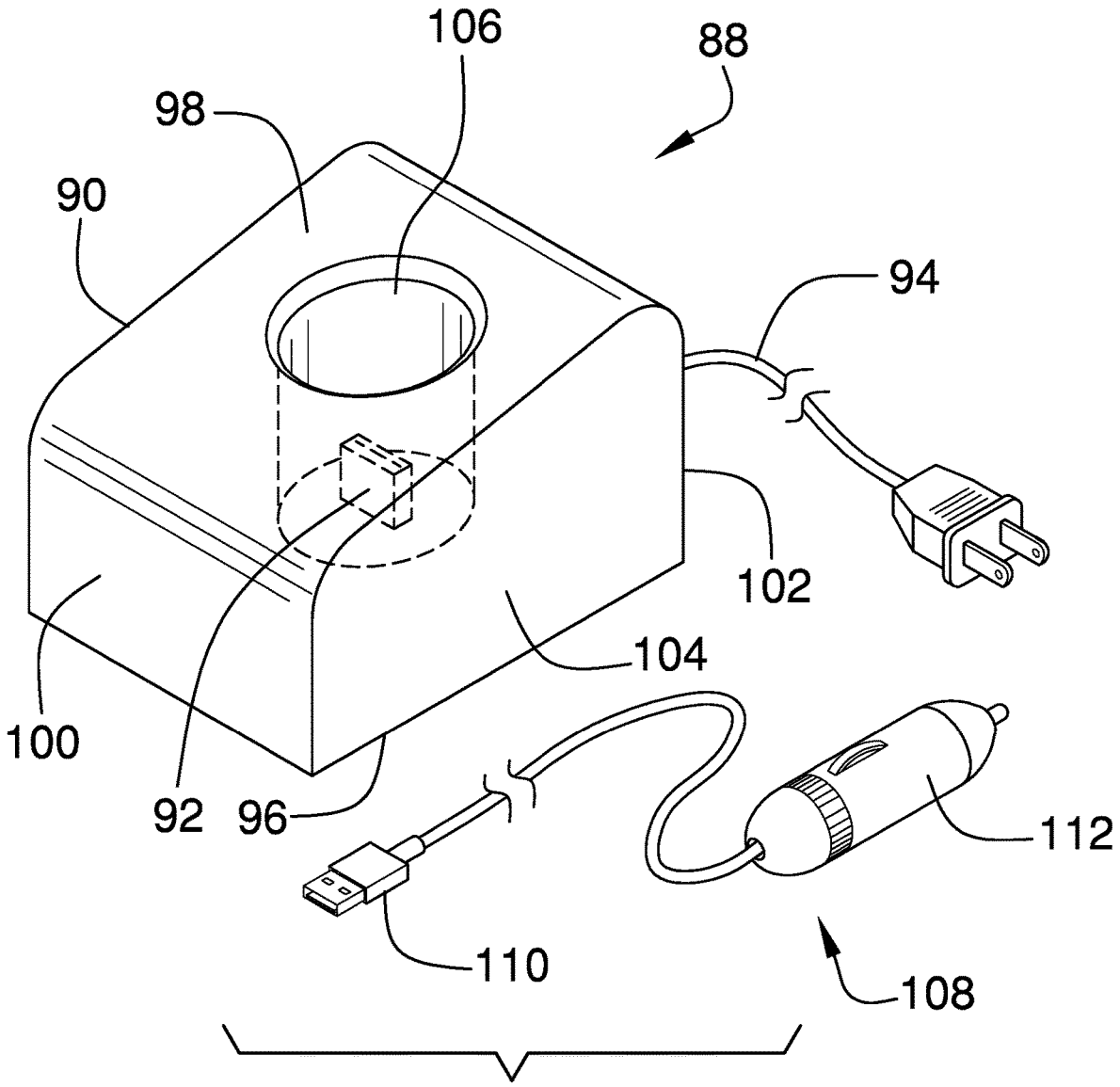
FIG. 5 is an isometric view of a charging dock and a car charger of an embodiment of the disclosure.

With reference now to the drawings, and in particular to FIGS. 1 through 5 thereof, a new blow-dryer embodying the principles and concepts of an embodiment of the disclosure and generally designated by the reference numeral 10 will be described.

As best illustrated in FIGS. 1 through 5, the battery powered collapsible blow-dryer 10 generally comprises a blow-dryer housing 12 having a recycled plastic outer wall 14, a ceramic inner wall 16, an exhaust end 18, an intake end 20, a dorsal side 22, and a ventral side 24. The exhaust end 18 has a first diameter 26 greater than a second diameter 28 of the intake end 20. A grill 30 is coupled within the exhaust end 18 of the blow-dryer housing. A light assembly 32 is coupled to the blow-dryer housing to provide light to a user when operating in poorly lit environments. The light assembly has a light housing 34, an LED 36, and a light control 38. The light housing 34 is coupled to the ventral side 24 of the outer wall proximal the exhaust end 18, the LED 36 is coupled within the light housing 34, and the light control 38 is coupled to the light housing. The LED is in operational communication with the light control.

A pivot hinge 40 is coupled to the ventral side 24 of the blow-dryer housing adjacent the intake end 20. A handle 42 has a handle cavity 44 disposed between an anterior side 46, a posterior side 48, an upper end 50, and a bottom end 52. The upper end has a pivot receptacle 54 pivotably coupled to the pivot hinge 40. The pivot receptacle comprises a locking mechanism 56 and a button 58. The locking mechanism maintains the handle in a folded position 60 or an alternate extended position 62, and the button 58 releases the handle from the folded position and the extended position. In the folded position the blow-dryer housing 12 and the handle 42 are folded together to minimize the overall size for storage and travel. In the extended position the blow-dryer housing and the handle are perpendicular for enhanced usability.

A blow-dryer assembly 64 comprises a heating element 66, a fan 68, and a plurality of controls 70. The heating element and the fan being are coupled within the blow-dryer housing 12 and the plurality of controls is coupled to the handle 42. The blow-dryer assembly takes air through the intake end 20, heats the air, and forces it through the exhaust end 18 of the blow-dryer housing. The ceramic inner wall 16 of the blow-dryer housing prevents heat damage to the recycled plastic outer wall 14. The plurality of controls 70 may comprise a power switch 72 and a fan speed control 74 coupled within the anterior side 46 of the handle. The power switch may be a rocker switch 76 to turn the heating element and the fan on and off, and the fan speed control may be a slider 78 to adjust the velocity of the fan.

A power assembly 80 comprises a solar panel 82, a rechargeable battery 84, and a charging port 86. The solar panel being may be coupled to the dorsal side 22 of the outer wall proximal the intake end 20 to maximize exposure to light from overhead sources. The rechargeable battery 84 is coupled within the handle cavity 44 and the charging port is coupled within the bottom end 52 of the handle through to the handle cavity. The rechargeable battery provides power to the blow-dryer assembly 64 and the light assembly 32 and is charged by attaching a cord to the charging port 86, which may be a USB port. The solar panel 82 provides additional power to the rechargeable battery 84 to extend usage time while the USB port is not plugged into a wall outlet.

A charging dock 88 comprises a dock housing 90, a power terminal 92, and a power cord 94. The dock housing has a bottom surface 96, an angled top surface 98, a front wall 100, a rear wall 102, and a pair of side walls 104. The top surface has a handle receptacle slot 106 extending through to proximal the bottom surface 96 with the power terminal 92 coupled within the handle receptacle slot. The handle receptacle slot receives the handle 42 such that the battery powered collapsible blow-dryer 10 is supported upright within the charging dock 88 with the power terminal 92 engaging the charging port 86. The power cord 94 is coupled to the power terminal 92 and passes through the rear wall 102 of the dock housing to be connected to a standard outlet. There may also be a car charger 108 with a male port terminal 110 and a cigarette lighter terminal 112. The male port terminal is selectively engageable with the charging port and the cigarette lighter terminal is configured to connect to a cigarette lighter port of a vehicle.

In use, the charging port 86 is connected to a power source either directly or through the charging dock 88 until the rechargeable battery 84 is charged. The user may then operate the blow-dryer 10 with the handle 42 in the extended position 62 using the plurality of controls 70. When operated in an environment with a strong light source, the solar panel 82 will charge the rechargeable battery to prolong its usage time. When operated in an environment with little light, the user may turn on the LED 36 using the light control 38. To store the blow-dryer 10, the user may press the button 58 of the pivot receptacle to move the handle from the extended position to the folded position 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A battery powered collapsible blow-dryer comprising:

a blow-dryer housing having a recycled plastic outer wall, a ceramic inner wall, an exhaust end, an intake end, a dorsal side, and a ventral side, the exhaust end having a first diameter greater than a second diameter of the intake end;

a grill coupled within the exhaust end of the blow-dryer housing;

a light assembly coupled to the blow-dryer housing, the light assembly having a light housing, an LED, and a light control, the light housing being coupled to the ventral side of the outer wall proximal the exhaust end, the LED being coupled within the light housing, the light control being coupled to the light housing, the LED being in operational communication with the light control;

a pivot hinge coupled to the blow-dryer housing, the pivot hinge being coupled to the ventral side adjacent the intake end;

a handle coupled to the pivot hinge, the handle having a handle cavity disposed between an anterior side, a posterior side, an upper end, and a bottom end, the upper end having a pivot receptacle, the pivot receptacle being pivotably coupled to the pivot hinge, the pivot receptacle comprising a locking mechanism and a button, the locking mechanism maintaining the handle in a folded position and an alternate extended position, the button releasing the handle from the folded position and the extended position;

a blow-dryer assembly comprising a heating element, a fan, and a plurality of controls, the heating element and the fan being coupled within the blow-dryer housing, the plurality of controls coupled to the handle, the blow-dryer assembly taking air through the intake end, heating said air, and forcing it through the exhaust end of the blow-dryer housing, the plurality of controls comprising a power switch and a fan speed control, the power switch and the fan speed control being coupled within the anterior side of the handle, the power switch being a rocker switch and the fan speed control being a slider, the power switch turning the heating element and the fan on and off, the fan speed control adjusting the velocity of the fan;

a power assembly comprising a solar panel, the rechargeable battery, and a charging port, the solar panel being coupled to the dorsal side of the outer wall proximal the intake end, the rechargeable battery being coupled within the handle cavity, the charging port being coupled within the bottom end of the handle through to the handle cavity, the solar panel and the charging port providing power to the rechargeable battery, the rechargeable battery providing power to the blow-dryer assembly and to the light assembly;

a charging dock comprising a dock housing, a power terminal, and a power cord, the dock housing having a bottom surface, an angled top surface, a front wall, a rear wall, and a pair of side walls, the top surface having a handle receptacle slot extending through to proximal the bottom surface, the power terminal being coupled within the handle receptacle slot, the power terminal being selectively engageable with the charging port, the power cord being coupled to the power terminal and passing through the rear wall of the dock housing; and a car charger, the car charger having a male port terminal and a cigarette lighter terminal, the male port terminal being selectively engageable with the charging port.

* * * * *